United States Patent [19]

Gordon

[11] Patent Number: 4,903,891

[45] Date of Patent: Feb. 27, 1990

[54] GABLE TOP CARTON SEALING CONSTRUCTION

[75] Inventor: Robert L. Gordon, Monroe, N.Y.

[73] Assignee: International Paper Company, Purchase, N.Y.

[21] Appl. No.: 376,455

[22] Filed: Jul. 7, 1989

[51] Int. Cl.[4] ..... B65D 5/74

[52] U.S. Cl. ..... 229/48 T; 206/621.1; 206/631.3; 229/125.42

[58] Field of Search ..... 229/48 T, 3.1, 123.1, 229/125.42; 206/621.1, 621.2, 631.2, 631.3

[56] References Cited

U.S. PATENT DOCUMENTS

| | | | |
|---|---|---|---|
| 2,927,865 | 3/1960 | Lewis Jr. et al. | 229/48 T |
| 3,071,305 | 1/1963 | Zinn | 229/17 |
| 3,297,227 | 1/1967 | Wallsten | 229/123.1 |
| 3,334,799 | 8/1967 | Crawford | 206/631.3 |
| 4,126,262 | 11/1978 | Thompson et al. | 206/631.3 |
| 4,411,365 | 10/1983 | Horikawa et al. | 206/607 |
| 4,433,784 | 2/1984 | Kjelgaard | 206/631.2 |
| 4,488,647 | 12/1984 | Davis | 229/48 T |
| 4,744,467 | 5/1988 | Jonsson et al. | 206/631.3 |
| 4,756,426 | 7/1988 | Wyberg | 206/631.3 |
| 4,762,234 | 8/1988 | Wyberg | 206/631.3 |
| 4,775,096 | 10/1988 | Andersson et al. | 229/125.42 |
| 4,792,048 | 12/1988 | Wyberg | 206/631.3 |

*Primary Examiner*—Gary Elkins
*Attorney, Agent, or Firm*—Walt Thomas Zielinski; Michael J. Doyle

[57] ABSTRACT

A pour spout seal construction for a gable top, thermoplastic coated type paperboard carton for packaging liquids. To permit easy unfolding of the folded pour spout within the top of the sealed carton by the consumer, the prior art has used adhesives to reduce the strength of the seal between the spout interior surfaces which are in surface contact with portions of the roof panels. In this invention, the opening action is different. Upon initial opening of the carton and subsequent unfolding of the pour spout, adhesive coating layers on the pour spout (located in positions homologous to the prior art adhesive coating layers) separate from the thermoplastic coating on the pour spout, instead of adhesive layers separating from themselves. Alternatively, the adhesive coating layers on the gable roof panels separate from the thermoplastic coating on the gable roof panels. In either case, the action is such that the adhesive coating layers stick to themselves upon pour spout unfolding. This invention does away with the need for adhesives, the latter sometimes permitting leaking and hence unsuitable for aseptic or so-called extended shelf life liquid packaging.

2 Claims, 2 Drawing Sheets

GABLE TOP CARTON SEALING CONSTRUCTION

BACKGROUND OF THE INVENTION

This invention relates to a gable top type carton fashioned from a unitary blank of paperboard, the blank being provided with a thermoplastic coating or layer on both surfaces and also provided with a plurality of fold lines to facilitate its assembly or erection.

The prior art is aware of a variety of constructions of gable top type paperboard cartons. After filling with a beverage, the top of the carton is closed and sealed, often by the application of heat and pressure along what is termed a fin or rib running across the top of the carton. The paperboard being coated with a thermoplastic material, typically polyethylene, such application of heat and pressure fuses certain surface portions of the polyethylene on opposing roof panels and on opposing pour spout panels, to thereby effect a seal. However, such a procedure for sealing the carton has had the disadvantage that upon initial opening, the polyethylene coatings which are adhered to each other do not easily separate, with the result that either the carton partially rips the polyethylene or separates from the paperboard fibers causing an unslightly appearance and making it difficult to open for dispensing of the beverage carried by it.

To overcome the problem of difficulty of opening, workers in this art have used what is termed abhesives on certain portions of the gable top panels which abut each other in the seal area and tack together prior to carton opening. An abhesive is a substance which will reduce the bond strength of the opposing surfaces ability to stick together. Abhesives are usually coated on strategic areas of the polymer surface. This coating prevents the bonding action available from the fused thermoplastic. The result being enough adhesion between the polymer layers to maintain the carton in a closed condition, with the remaining abutting surfaces of the gable top being coated with abhesive to facilitate easier opening. The perimeter abutting the abhesive coating is not coated. A heat seal bond is achieved around this abhesive thus keeping the container closed during transit. An example of an adhesive construction is shown in U.S. Pat. Re. No. 26,305 issued to Huang et al. There, abhesive coatings are denoted by the numerals 83, 84, 85 and 86 of FIG. 1, as well as abhesive coatings 87 and 88 of FIG. 2. Another typical prior art construction employing abhesives is given in U.S. Pat. No. 4,775,096 issued to Anderson et al. In the Huang construction, the abhesive coatings are employed both on the interior surface of the pouring spout, as well as on the exterior surface (the latter coatings denoted by the numerals 87 and 88), while in the Andersson patent, abhesive coatings D and E are employed on the internal pour spout surfaces, as well as C and F on the roof fin seal panels.

While solving the problem of permitting ease of opening by the consumer of the carton without tearing of the paperboard, the use of abhesive coatings has a significant drawback in the packaging of liquids which are intended to be stored over extended periods of time. Such packages have been termed extended shelf life packages. The use of abhesives does not produce as complete as seal as is possible with an adhesive. Accordingly, up until the time of this invention, manufacturers of gable top paperboard cartons for beverages which are intended for long shelf life have not had available to them a carton construction which will permit easy initial opening of the carton. In addition, the use of abhesives for refrigerated products has long been practiced in the industry. This abhesive has caused problems in leakage if too much is used and, conversely, problems in opening when too little is used. The control of the abhesive material lay down is critical and difficult under normal production conditions.

SUMMARY OF THIS INVENTION

According to the practice of this invention, a novel adhesive arrangement is employed for sealing together the usual abutting surfaces of a gable top type carton. According to the invention, the thermoplastic coating is provided in the usual carton panel areas with an adhesive (as opposed to an abhesive) with the adhesive coating being so formulated with respect to the thermoplastic coating that, upon initial opening by the consumer, the adhesive coatings will adhere to each other, with one of these adhesive coatings (of an abutting pair of them) separating from its respective thermoplastic coating, with the other adhesive coating of the same abutting pair remaining with its respective thermoplastic coating. This action occurs due to the greater affinity of the adhesive for itself than for the thermoplastic coating on the paperboard.

By this selection of adhesive, the advantages of an adhesive seal may be enjoyed, while at the same time the same consumer ease of opening afforded by prior art abhesive coatings is also realized. The adhesive will flow when heated and will thus tend to cork any potential channels in the opposing surfaces of the fin seal area of the gable top, such as channels near a fold line. The invention is independent of the particular pattern of application of the adhesive coatings, with any of the prior art patterns of abhesive coatings being available to those practicing this invention.

DETAILED DESCRIPTION OF THE INVENTION

Figure 1:
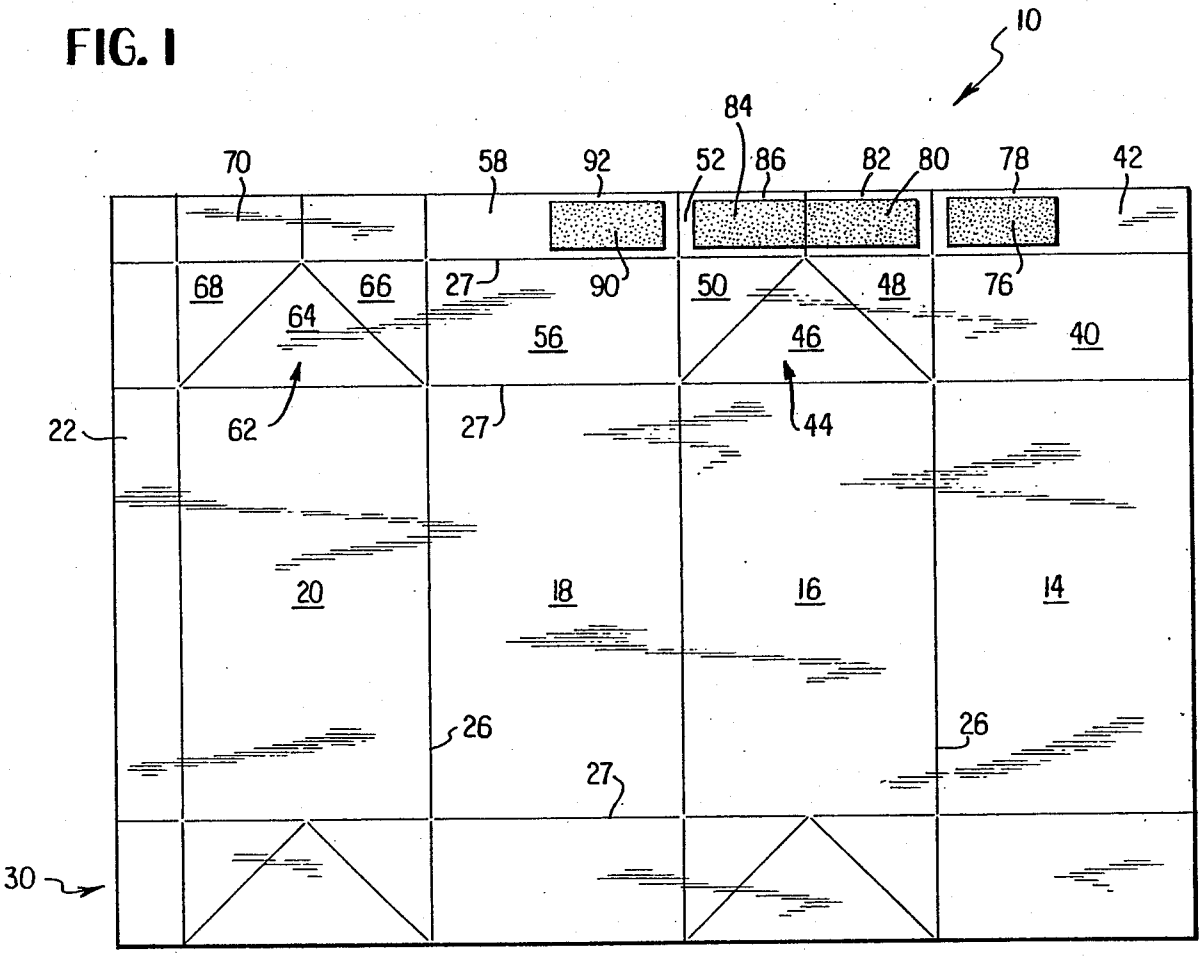
FIG. 1 is a plan view of a unitary blank of thermoplastic coated paperboard from which a carton embodying this invention is formed. That surface of the blank which is adapted to form the interior of the carton faces the reader.

Referring now to FIG. 1 of the drawings, the numeral 10 denotes generally a unitary blank of thermoplastic coated paperboard, typically coated with polyethylene, from which the carton of this invention is formed. The blank includes a plurality of sidewall forming panels 14, 16, 18 and 20, the latter panel provided with the usual manufacturer's flap 22. These sidewall panels, together with other panels later to be described, are defined by a plurality of generally vertically extending fold lines 26 and a plurality of generally horizontally extending fold lines 27, both sets defined by scores on the blank.

The numeral 30 denotes generally bottom closure forming panels of the blank, with a typical prior art construction for such panels being illustrated. It will be understood that the precise configuration of the bottom forming panels forms no part of this invention.

Side panels 14 and 18 are provided, respectively, with roof panels 40 and 56. Roof panel 40 is provided at its top edge by fin seal panel 42, while roof panel 56 is provided at its top edge with fin seal panel 58. Side panel 16 is provided with a gusset panel denoted generally by the numeral 44, the gusset panel including three triangular panels 46, 48 and 50. Fin seal panel 52 is positioned at the top edges of these latter three triangular panels. Similarly, side forming panel 20 is provided with a gusset panel denoted generally by the numeral 62, the latter including triangular panels 64, 66 and 68, these panels formed by the score lines, as are panels 46, 48 and 50. Fin seal panel 70 is positioned above gusset panel 62. The numerals 76, 80, 84 and 90 denote areas where an adhesive is placed on the thermoplastic coating of the blank prior to its folding. The numerals 78, 82, 86 and 92 represent adhesive free areas on their respective fin seal panels, these areas extending the full panel width. Areas 78 and 92 are adapted to be heat sealed together to form a continuous seal along the top fin or rib of the erected container.

That surface of blank 10 which faces the reader is adapted to be the interior surface of the completed carton, with the indicated adhesive areas also facing the reader.

Figure 2:
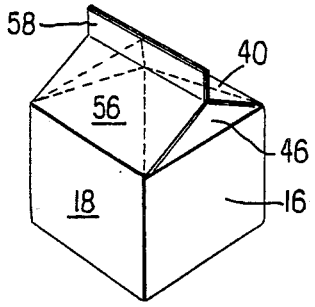
FIG. 2 is a partial perspective view of the upper portion of a typical gable top container, such as one employed in this invention.

Referring now to FIG. 2 of the drawings, the carton is illustrated as having been erected, filled and sealed and ready for an initial dispensing. FIG. 2 shows a typical gable top carton construction having two opposite roof panels 40 and 56, each with an upper fin panel, one of which, 58, is shown. The numeral 46 denotes a portion of gusset panel 44 which is opposite to the (not illustrated) gusset panel 62.

Figure 3:
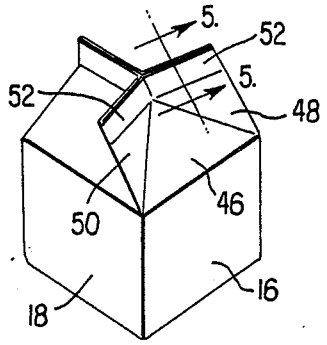
FIG. 3 is a view showing the initial step of opening a gable top container, such as that of FIG. 2.

FIG. 3 shows the usual mode of initiation of opening of a gable top container. There, the slanted gable roof panels 40 and 56 are grasped and spread at their ends nearest the reader, with these roof panels and associated triangular panels 48 and 50 spread apart as indicated at FIG. 3.

Figure 4:
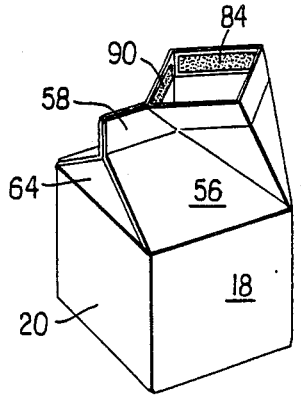
FIG. 4 is a view illustrating the gable top container of FIG. 2 with the folded spout of the container now being opened or unfolded.

Next, as shown at FIG. 4, the user bends the flaps back and opens folded gusset panel 44 to form the pour spout. Adhesive areas 84 on fin seal 52 and adhesive area 90 on fin seal 58 are shown.

Figure 5:
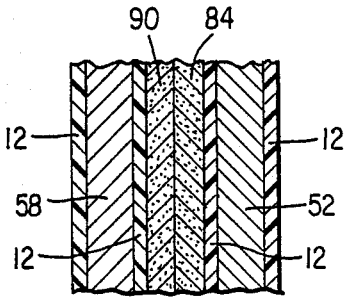
FIG. 5 is a view taken along Section 5—5 of FIG. 3.
Figure 6:
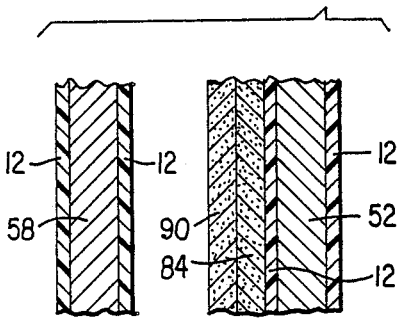
FIG. 6 is a view similar to FIG. 5, and illustrates the release of adhesive coating of this invention from one of the thermoplastic layers from one of the roof panels of the gable top carton.

Referring now to FIGS. 5 and 6 of the drawings, the improvement of this invention will readily be comprehended. FIG. 5 a portion of roof fin seal 58 abutting against in surface to surface contact with a portion of pour spout fin seal 52. The polyethylene coating 12 is shown and coats both portions 52 and 58, with adhesive 84 applied to fin seal 52 and adhesive 90 applied to fin seal 58.

FIG. 6 is a view similar to FIG. 5 illustrating the initial separation of fin seal portion 52 from fin seal portion 58. Adhesive coating 90 is shown as having remained with adhesive coating 84, coating 90 having separated from its respective thermoplastic layer 12 upon separation of these fin seals. Alternatively, the adhesive coating 84 may separate from its respective thermoplastic coating 12, remaining with adhesive coating 90, but with the latter remaining adhered to its respective thermoplastic coating 12 on fin seal 58. FIG. 6 thus represents one of two possible actions, the action not illustrated being easily visualized.

The other half of the pour spout, being that portion which was originally closed by adhesion between adhesive coatings 76 and 80 experiences an opening action entirely similar to that shown at FIG. 6.

In practice, as shown in U.S. Pat. No. 4,775,096 issued to Andersson et al, only the uppermost portion of the fin seal running along the top edge may be sealed. Alternatively, the fin seal panels 42 and 58 of the slanted gable roof panels 40 and 56 may be provided with extensions which are sealed together by the application of heat and pressure to the thermoplastic coating 12, as in the manner shown by panels 45 and 46 of FIG. 1 of U.S. Pat. Re. No. 26,305, issued to Huang et al. If the fin seal panels 42 and 58 are provided with somewhat elongated extensions, above that shown at FIG. 1, then the adhesive coatings 76 and 90 may extend all the way up to the horizontal free end of the blank shown at FIG. 1. Similarly, adhesive coatings 80 and 84 may likewise extend all the way up to the upper horizontal free edge of the blank, thus, there would be no areas corresponding to 78, 82, 86 and 92. These variations in carton construction and adhesive application are not significant for the practice of this invention, the invention being defined by the novel action of adhesive being employed instead of abhesive, with the applied adhesive coatings adhering together upon opening the carton and unfolding of the carton spout.

FIG. 1 has illustrated the application of adhesive coatings only to the carton inner forming surface which faces the reader of FIG. 1. If desired, as indicated by numerals 87 and 88 of the noted Huang patent (which employs abhesive) additional adhesive patterns may be employed to the undersigned of the blank, i.e., opposite adhesive coatings 80 and 84 as shown at FIG. 1. However, most applications of this invention will require adhesive patterns only on the inner carton forming surfaces, as illustrated.

The description of FIG. 6 has noted that adhesive coatings 84 and 90 may, after initial opening of the pour spout, remain with either fin seal 42 or alternatively, they remain with fin seal 58. With present methods of manufacture of a carton embodying this invention, it cannot be predicted which action will occur. However, as it has been experimentally determined that these adhesive coatings 84 and 90 will always remain together, no matter which fin seal they separate (delaminate) from.

An FDA approved modified polyvinylacetate adhesive, effective for delamination, was employed as adhesive coatings 76, 80, 84, and 90. This adhesive is available from H. B. Fuller Co. under code number WC 3458. This adhesive dries tack free to prevent sticking of the fabricated carton blanks when they are stacked prior to setting up. The thermoplastic coating 12 is generally made of extrusion grade low density polyethylene in thicknesses of from 0.5 to 2.0 mils.

I claim:

1. A thermoplastic coated paperboard blank for forming a gable top type carton, the blank provided with fold and crease lines to form side panels, bottom closure panels, and gable top panels, each of said gable top panels having an upper free edge, the gable top panels including two alternate gable roof forming panels and two alternate gusset panels, each gusset panel including three triangular panels and a fin seal panel, each roof panel including a fin seal panel, one of said gusset panels termed a spout panel which is adapted to form a pour spout, an adhesive coating on said spout panel extending from contiguous to said free edge down towards said side panels and covering at least a portion of the fin seal panel of said spout panel, an adhesive coating on a portion of the fin seal panels of each of those roof panels adjacent said spout panel, said adhesive coatings comprised of a polyvinylacetate, the adhesion between said adhesive coatings being greater than the adhesion between said adhesive coatings and said thermoplastic coating on the paperboard.

2. A gable top type carton formed of a unitary blank of thermoplastic coated paperboard which has been provided with fold lines, the fold lines defining side panels, bottom closure forming panels and roof panels, the roof panels forming an upper carton closure, the roof panels including two opposite, slanting gable panels, the upper end of each of said gable panels including a fin seal panel, the uppermost edges of said fin seal panels sealed together the roof panels also including two opposite gusset panels, each gusset panel including three triangular panels and an upper fin seal panel, the gusset panels each folded inwardly to thereby form, with the fin panels of the roof panels, a fin of four layers thickness along the roof of the gable top carton, one of said gusset panels being a folded pour spout, at least a portion of the interior surface of the fin seal of each gable panel having a coating adhesively sealed to a respective abutting, adhesively coated inner surface of the fin seal of the pour spout by an adhesive coating comprised of a polyvinylacetate to thereby define two pairs of abutting adhesively coated surfaces, whereby the adhesive flows and calks any potential channels in the opposing surfaces of the fin seal area of the gable top, such as channels near a fold line, and whereby upon opening of the carton and unfolding of the folded pour spout one of each of the adhesive coatings of each pair of said abutting, adhesively coated surfaces separates from a respective thermoplastic coating and adheres to its respective abutting adhesive coating, whereby the adhesive coating yields a sealing action superior to prior art adhesive coatings yet permits unfolding of the pour spout without tearing of the paperboard.

* * * * *

UNITED STATES PATENT AND TRADEMARK OFFICE

CERTIFICATE OF CORRECTION

PATENT NO. : 4,903,891

DATED : Feb. 27, 1990

INVENTOR(S) : Robert L. Gordon

It is certified that error appears in the above-identified patent and that said Letters Patent is hereby corrected as shown below:

In The Abstract:

Line 5, change "adhesives" to -- abhesives --.

Line 14, change "adhesive" to -- abhesive --.

Line 20, change "adhesives" to -- abhesives --.

In the Claims:

Column 6, line 22, change "adhesive" to --abhesive--.

Signed and Sealed this

Twenty-third Day of July, 1991

*Attest:*

HARRY F. MANBECK, JR.

*Attesting Officer*

*Commissioner of Patents and Trademarks*